US008783272B2

(12) United States Patent
Oppel et al.

(10) Patent No.: US 8,783,272 B2
(45) Date of Patent: Jul. 22, 2014

(54) METHOD FOR MANUFACTURING A WATER-BEARING DOMESTIC APPLIANCE

(75) Inventors: Anton Oppel, Syrgenstein (DE); Bernd Schessl, Dillingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1201 days.

(21) Appl. No.: 12/672,524

(22) PCT Filed: Aug. 26, 2008

(86) PCT No.: PCT/EP2008/061155

§ 371 (c)(1),
(2), (4) Date: Feb. 8, 2010

(87) PCT Pub. No.: WO2009/027402

PCT Pub. Date: Mar. 5, 2009

(65) Prior Publication Data

US 2011/0155187 A1 Jun. 30, 2011

(30) Foreign Application Priority Data

Aug. 31, 2007 (DE) ..... 10 2007 041 314

(51) Int. Cl.
*B08B 3/00* (2006.01)
*B23P 17/04* (2006.01)

(52) U.S. Cl.
USPC ..... 134/117; 134/56 D; 29/428

(58) Field of Classification Search
USPC ..... 134/117, 56 D; 29/428
See application file for complete search history.

(56) References Cited

U.S. PATENT DOCUMENTS

| | | | | |
|---|---|---|---|---|
| 2,264,307 | A | 12/1941 | Haberstump | |
| 3,443,719 | A * | 5/1969 | Duncan | 220/378 |
| 3,829,191 | A * | 8/1974 | Jenkins | 312/228.1 |
| 4,538,433 | A | 9/1985 | Durazzani | |
| 6,045,203 | A * | 4/2000 | Marks et al. | 312/228 |
| 6,045,205 | A * | 4/2000 | Dingler | 312/351.7 |
| 6,563,072 | B1 | 5/2003 | Ohmi et al. | |
| 6,823,878 | B1 * | 11/2004 | Gadini | 134/58 D |
| 2007/0009755 | A1 * | 1/2007 | Ben et al. | 428/543 |
| 2009/0126765 | A1 | 5/2009 | Buehlmeyer et al. | |

FOREIGN PATENT DOCUMENTS

| | | | |
|---|---|---|---|
| DE | 1130787 | | 6/1962 |
| DE | 1760914 | | 1/1972 |
| EP | 0018522 | A1 | 11/1980 |
| EP | 0234243 | A1 | 9/1987 |
| EP | 0372360 | A2 | 6/1990 |
| EP | 1138248 | A2 | 10/2001 |
| GB | 977551 | | 12/1964 |
| WO | 2008061878 | A1 | 5/2008 |

OTHER PUBLICATIONS

Grote, K.H.: Dubbel, Taschenbuch fuer den Maschinenbau, Berlin [u.a.]: Springer, 2005, ISBN: 3-540-22142-5.

* cited by examiner

*Primary Examiner* — Michael Barr
*Assistant Examiner* — Benjamin L Osterhout
(74) *Attorney, Agent, or Firm* — James E. Howard; Andre Pallapies

(57) ABSTRACT

A method for manufacturing a water-bearing domestic appliance having a washing container to accommodate items to be washed, wherein the washing container is at least partially formed by at least two different metallic materials.

37 Claims, 4 Drawing Sheets

METHOD FOR MANUFACTURING A WATER-BEARING DOMESTIC APPLIANCE

BACKGROUND OF THE INVENTION

The invention relates to a method for manufacturing a water-bearing domestic appliance, in particular a dishwasher or washing machine, at least having a washing container for accommodating the items to be washed, said washing container being formed at least in portions from metal materials, in particular from stainless steel.

Water-bearing domestic appliances, like for instance dishwashers, have a washing container, in which the items to be washed are introduced into removably mounted racks. During a cleaning process, washing liquor is applied to the items to be washed.

Washing containers of this type can be manufactured from stainless steel, plastic or a combination of these materials. In such cases the washing container can consist of 2 or 3 main components, for instance in the case of three main components of a base with a tub rear panel and a tub jacket with a roof, of a base, a tub jacket with a roof and rear panel and of a base, a tub jacket with a rear wall and a roof. Main components of the washing container can be manufactured from stainless steel or plastic or it is also conceivable for one or two of the cited main components to be manufactured from stainless steel and the remaining parts to be manufactured from plastic.

The main components of a washing container made of stainless steel can be welded to one another and brought into a desired form by means of a corresponding expansion method. Austenitic steel is used here for the main components of the washing container, it being possible for said steel to have a high nickel content (>8%, e.g. 1.4301) for instance. This austenitic steel is characterized by a good deformability and weldability. The high nickel content of austenitic steels of this type is nevertheless costly in terms of materials. A more cost-effective alternative to austenitic steels are so-called ferritic steels, which can however only be marginally deformed as a result of their minimal elasticity compared with austenitic steels and are thus not suited to deformation using the expansion method.

BREIF SUMMARY OF THE INVENTION

It is therefore the object of the invention to demonstrate a way of reducing material costs.

The object of the invention is achieved by a method for manufacturing a water-bearing domestic appliance, in particular a dishwasher or washing machine, at least having a washing container for accommodating the items to be washed, which is formed at least in portions from metallic materials, in particular from stainless steel, with provision inventively being made for at least two different metallic materials to be used to form the washing container. Here the metallic materials may be different metals and/or alloys or also modifications of a metallic material with different material properties, in particular in respect of processability. This measure surprisingly enables material costs to be reduced, since, it is possible to select the corresponding metals with the necessary properties in accordance with the requirements of a subsequent deformation process for instance, like an expansion method for example, Provision is therefore preferably made for use to be made of metallic materials with a different austenite former content, i.e. modifications of a metallic material like for instance stainless steel. An expensive but effectively deformable and weldable metal is thus used in the regions in which significant deformations are provided and/or welding seams are applied. By contrast, other regions which are not exposed to any deformation of this type or are not welded are manufactured from metal with a lower content of austenite formers.

Here the austenite formers can preferably be nickel, cobalt and/or manganese. An austenitic metal is therefore preferably used, which has a particularly good formability and weldability as mentioned above. Furthermore, provision is preferably made for a ferritic metal to be used, the property of which is suitable for manufacturing regions which are not subjected to significant deformation.

The washing container is preferably formed from at least two main components. A main component here is understood to mean an integral part of the washing container, which forms at least the roof, the base, one of the side panels or the rear panel of a washing container. A main component can however also include several surfaces which delimit the interior space of the washing container. Provision is preferably made here for at least one of the main components to be manufactured from at least two different metallic materials, i.e. one of the main components is formed from a heterogenous material combination.

To prevent corrosion defects, in particular crevice corrosion, provision is made for a plastic seal to be attached at least in a connection area of the at least two different metallic materials.

Provision is preferably made here for a different insulating coating to be applied to at least a connection area of the at least two different metallic materials so as to ensure that no chemically favorable corrosion and in particular crevice corrosion results in the connection areas of the two different metallic materials, since the electrochemical corrosion process is prevented by means of the sealing with plastic and/or the electrically insulating coating.

In an alternative embodiment, provision is made for a passivation to be applied in at least one connection area of the at least two different metallic materials. Here the passivation prevents the diffusion so that a continuation of the corrosion of the material is stopped.

Provision is preferably made for the passivation to contain chrome. Here the chrome forms a chrome oxide layer, which prevents further oxidation. It is advantageous that the oxide layer, for instance in the event of damage, renews by means of contact with the atmosphere, i.e. the passivation is self-healing. Instead of chrome, other materials can also be used, like for instance aluminum, titanium, lead, zinc or silicon. Furthermore, provision can be made during the manufacturing method to accelerate the embodiment of the passivation, e.g. by treatment with azotic acids or citric acids.

In an alternative embodiment, provision is made for at least one sacrificial anode to be arranged. I.e. a block made of an electrochemical ignoble metal, i.e. a metal having a low potential, is electrically conductively connected to the noble metal to be protected, i.e. the metal with the highest content of austenite former. In an aqueous solution, as represented by the washing liquor inside a water-bearing domestic appliance such as a dishwasher, the sacrificial anode and the metal with the higher content of austenite formers form a local element, with the sacrificial anode slowly breaking down over time and thus protecting the noble metal, i.e. the metal with the higher content of austenite formers, from corrosion.

In a further alternative embodiment, provision is made for at least one parasitic anode to be arranged. The parasitic anode has an electrical connection with a direct voltage, which is supplied for instance by a mains supply circuit of the water-bearing domestic appliance, such as a dishwasher for instance. The metal to be protected, i.e. the metal with the higher austenite former content, is connected in this way to the negative pole of the voltage source and the positive pole with the parasitic anode. A protective current develops, which prevents the electrochemically-specific corrosion.

Provision is preferably made for at least a deformation to take place after connecting the at least two different materials, in particular by producing a welded connection, at least in the region of one of the materials, in particular an austenitic metal. This may be a roller seam welding method for manufacturing the welded connection and the deformation may be an expansion process.

A water-bearing domestic appliance, in particular a dishwasher or washing machine, also belongs to the invention, and comprises at least a washing container for accommodating items to be washed, which is formed at least in portions from metallic material, in particular from stainless steel, with the container inventively being manufactured from at least two different metallic materials.

Further advantageous developments of the invention are specified in the subclaims.

BRIEF DESCRIPTION OF THE DRAWINGS

The invention is described in more detail below with reference to a drawing, in which.

DETAILED DESCRIPTION OF EXEMPLARY EMBODIMENTS OF THE PRESENT INVENTION

Figure 1:
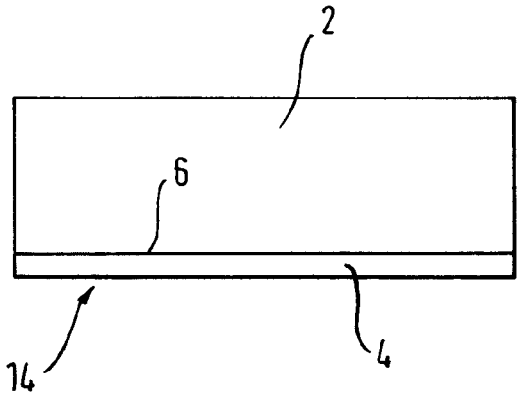
FIG. 1 shows a first step of an exemplary embodiment of the inventive method for manufacturing a washing container for a water-bearing domestic appliance, in particular a dishwasher.
Figure 2:
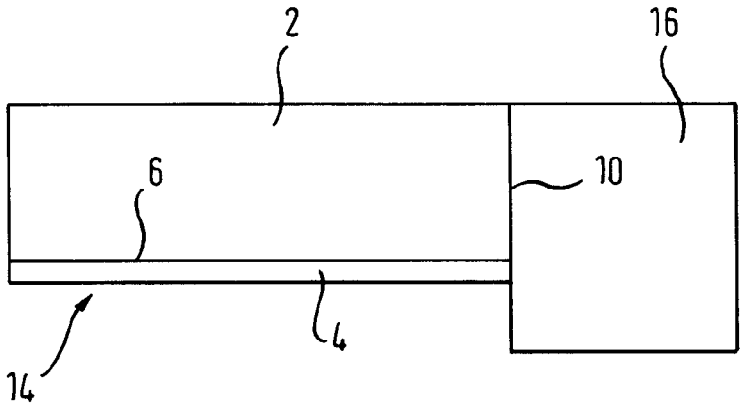
FIG. 2 shows a second step of an exemplary embodiment of the inventive method for manufacturing a washing container for a water-bearing domestic appliance, in particular a dishwasher.
Figure 3:
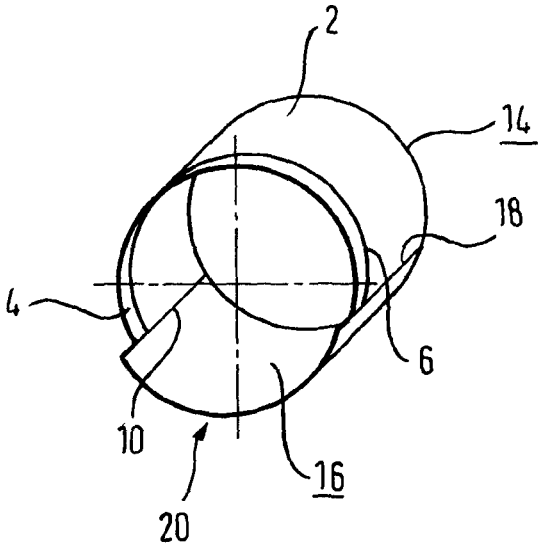
FIG. 3 shows a third step of an exemplary embodiment of the inventive method for manufacturing a washing container for a water-bearing domestic appliance, in particular a dishwasher.
Figure 4:
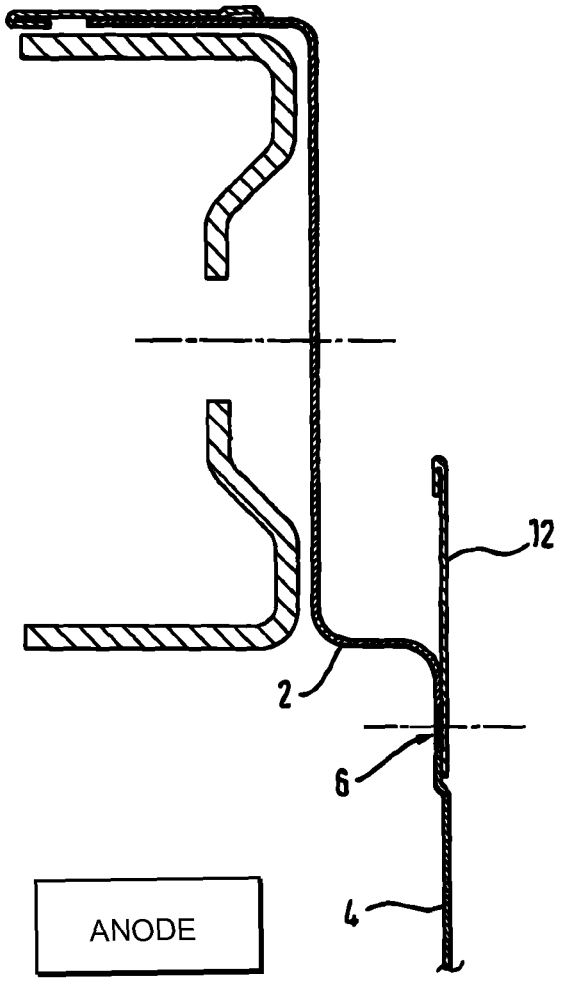
FIG. 4 shows a schematic sectional view of an inventive washing container

Reference is made to FIGS. 1 to 3.

A rectangular metallic section forming a casing plate 14 is shown, which, together with a base plate 15, forms the washing container, for instance of a dishwasher (cf. FIG. 1).

The casing plate 14 is formed here from a larger section 2 made of ferritic metal 2 and a significantly smaller section 4 made of an austenitic metal.

These two sections 2, 3 have been connected to one another along a connection area 6 by means of roller seam welding or laser welding.

In a next step (cf. FIG. 2), the base plate 16 is likewise welded to the casing plate 14 by means of roller seam welding or laser welding. Here the base plate 16 is manufactured from an austenitic metal. The connection area 10 between the casing plate 14 and the base plate 16 extends both in a region with austenitic metal and also in a region with ferritic metal.

In a further step, the thus obtained semi-finished product is molded into a cylinder and is closed along an assembly seam 18 by means of roller seal welding or laser welding (cf. FIG. 3). Here the area of the front side 20, in which the container door of a finished dishwasher is subsequently arranged, is manufactured from austenitic metal, thereby allowing for large deformations in this area. The same applies to the area of the base plate 16. The large section of the casing plate 15 is by contrast manufactured from ferritic metal, thereby only allowing for minor metal deformations.

The manufacture of the washing container is then carried out by means of an expansion method, in which the cylindrical base body is converted into a square. The arrangement of the austenitic and ferritic steels ensures that an adequate deformability is provided in the areas which are exposed to significant metal deformation. Ferritic steels are arranged in the other areas which are not exposed to significant metal deformation. A container rear panel is then welded onto complete the washing container (not shown).

Furthermore the dimensions of the casing plate 14 and the base plate 16 are selected such that welds in the completed washing container, for instance in the connection area 6, are hidden from an operator by a sealing seat frame 12 and are thus arranged invisibly. Furthermore, means for avoiding crevice corrosion can also be provided (not shown). This may involve sealing with plastic or with another electrically insulating coating. Alternatively hereto, a passivation can also be applied, which inter alia contains chrome and by embodying a chrome oxide layer effects a passivation and thus prevention of crevice corrosion.

Finally, a sacrificial anode can also be provided, which, as a result of its application, prevents the crevice corrosion. Provision can finally also be made for a parasitic current anode to be arranged, which is connected to a direct voltage source of a water-bearing domestic appliance and therefore prevents electrochemical-specific corrosion.

LIST OF REFERENCE CHARACTERS

2 Section
4 Section
6 Connection area
8 Washing container
10 Connection area
12 Door seat frame
14 Casing plate
16 Base plate
18 Connection area
20 Front panel

The invention claimed is:

1. A method for manufacturing a water-bearing domestic appliance having a washing container to accommodate items to be washed, the method comprising forming the washing container at least partially by at least two different metallic materials by joining the two different metallic materials to one another along a seam.

2. The method of claim 1, wherein the water-bearing domestic appliance is one of a dishwasher and a washing machine.

3. The method of claim 1, wherein at least one of the two different metallic materials is stainless steel.

4. The method of claim 1, wherein the at least two different metallic materials have a respectively different content of austenite formers.

5. The method of claim 4, wherein the austenite formers are at least one of nickel, cobalt and manganese.

6. The method of claim 1, wherein at least one of the at least two different metallic materials is austenitic metal.

7. The method of claim 1, wherein at least one of the at least two different metallic materials is ferritic metal.

8. The method of claim 1, wherein a plastic sealer is applied to at least a predetermined connection area of the at least two different metallic materials.

9. The method of claim 1, wherein the washing container is formed by at least two main components.

10. The method of claim 9, wherein at least one of the at least two main components is manufactured from the at least two different metallic materials.

11. The method of claim 9, wherein at least one of the at least two main components forms at least one of a base, a container rear panel, and a roof of the washing container.

12. The method of claim 1, wherein an electrically insulating coating is applied at least in the predetermined connection area of the at least two different metallic materials.

13. The method of claim 1, wherein a passivation is applied at least in a predetermined connection area of the at least two different metallic materials.

14. The method of claim 13, wherein the passivation contains chrome.

15. The method of claim 1, further comprising arranging a sacrificial anode.

16. The method of claim 1, further comprising arranging a parasitic anode.

17. The method of claim 1, wherein at least one deformation takes place after connecting the at least two different metallic materials by a weld connection at least in a predetermined area of an austenitic metal.

18. A water-bearing domestic appliance, comprising:

a washing container to accommodate items to be washed, the washing container formed at least partially by at least two different metallic materials, wherein the two different metallic materials are fixedly joined to one another along a seam.

19. The water-bearing domestic appliance of claim 18, wherein the water-bearing domestic appliance is one of a dishwasher and a washing machine.

20. The water-bearing domestic appliance of claim 18, wherein at least one of the two different metallic materials is stainless steel.

21. The water-bearing domestic appliance of claim 18, wherein the at least two different metallic materials have a respectively different content of austenite formers.

22. The water-bearing domestic appliance of claim 18, wherein the austenite formers are at least one of nickel, cobalt and manganese.

23. The water-bearing domestic appliance of claim 18, wherein at least one of the at least two different metallic materials is austenitic metal.

24. The water-bearing domestic appliance of claim 18, wherein at least one of the at least two different metallic materials is ferritic metal.

25. The water-bearing domestic appliance of claim 18, wherein the washing container is formed by at least two main components.

26. The water-bearing domestic appliance of claim 18, further comprising a plastic sealer provided in at least a predetermined connection area of the at least two different metallic materials.

27. The water-bearing domestic appliance of claim 18, further comprising an electrically insulating coating provided in at least a predetermined connection area of the at least two different metallic materials.

28. The water-bearing domestic appliance of claim 18, further comprising a passivation provided in at least a predetermined connection area of the at least two different metallic materials.

29. The water-bearing domestic appliance of claim 28, wherein the passivation contains chrome.

30. The water-bearing domestic appliance of claim 18, further comprising a sacrificial anode.

31. The water-bearing domestic appliance of claim 18, further comprising a parasitic anode.

32. The water-bearing domestic appliance of claim 18, wherein the at least two different metallic materials form the base and two side panels of the washing container.

33. The water-bearing domestic appliance of claim 18, wherein the two different metallic materials are welded to one another.

34. The water-bearing domestic appliance of claim 18, wherein the washing container is substantially square.

35. The water-bearing domestic appliance of claim 34, wherein:

the substantially square shape is formed by expanding a cylinder, the two different metallic materials are austenitic steel and ferritic steel, and the ferritic steel is disposed in areas that do not undergo significant metal deformation.

36. A water-bearing domestic appliance, comprising:

a washing container to accommodate items to be washed, the washing container formed at least partially by at least two different metallic materials, wherein the washing container is formed by at least two main components, and at least one of the at least two main components is manufactured from the at least two different metallic materials.

37. The water-bearing domestic appliance of claim 25, wherein at least one of the at least two main components forms at least one of a base, a container rear wall, and a roof of the washing container.

* * * * *